United States Patent [19]

Kitada et al.

[11] Patent Number: 4,955,327

[45] Date of Patent: Sep. 11, 1990

[54] PARTIAL-BOIL COOLING APPARATUS FOR ENGINE

[75] Inventors: Taizo Kitada, Okazaki; Takehiko Katsumoto; Osamu Hirako, both of Kyoto; Masatoshi Ninoyu, Okazaki; Yasuyuki Makigawa, Amagasaki; Gorou Yamanaka, Amagasaki; Masao Fujii, Amagasaki, all of Japan

[73] Assignees: Mitsubishi Jidosha Kogyo Kabushiki Kaisha; Mitsubishi Denki Kabushiki Kaisha, both of Tokyo, Japan

[21] Appl. No.: 422,393

[22] Filed: Oct. 17, 1989

[30] Foreign Application Priority Data

Oct. 17, 1988 [JP] Japan ..... 63-261045

[51] Int. Cl.[5] ..... F01P 3/00

[52] U.S. Cl. ..... 123/41.42; 123/41.2

[58] Field of Search ..... 123/41.42, 41.19, 41.2, 123/41.21

[56] References Cited

U.S. PATENT DOCUMENTS

| | | | |
|---|---|---|---|
| 848,886 | 4/1907 | Duryea | 123/41.42 |
| 1,226,180 | 5/1917 | Bouton, Jr. | 123/41.2 |
| 2,413,770 | 1/1947 | Knoy | 123/41.42 |

*Primary Examiner*—Noah P. Kamen

*Attorney, Agent, or Firm*—Wegner & Bretschneider

[57] ABSTRACT

In a cooling apparatus for an engine, a water jacket is divided into two parts, namely a forcible circulation part located chiefly round a cylinder head, and a natural convection part located chiefly round a liner of a cylinder block. The natural convection part is filled at its upper space with a cooling water and at its lower space with a cooling medium different from the cooling water. The cooling medium has a boiling point around a temperature zone to cool the liner, and also has a specific gravity larger than that of the cooling water and immiscible with the cooling water.

4 Claims, 7 Drawing Sheets

PARTIAL-BOIL COOLING APPARATUS FOR ENGINE

BACKGROUND OF THE INVENTION (1) Field of the Invention

This invention relates to an apparatus for cooling an engine, and more particularly to a partial-boil cooling apparatus in which the combined boiling and cooling action of an additional cooling medium different from a cooling water is utilized for partial cooling.

(2) Description of the Related Art

Heretofore the majority of modern cooling apparatuses for engines are of the type using water as a coolant. This water-cooling type of cooling apparatuses are exemplified by a cooling apparatus shown in FIGS. 4 and 5 of the accompanying drawings FIG. 4 is a vertical cross-sectional view of an engine, and FIG. 5 is a side elevational view of the engine.

In FIGS. 4 and 5, reference numeral 1 designates an engine; 2, a cylinder block partially constituting a body of the engine 1; 3, a cylinder head partially constituting the body of the engine 1; and 4, an oil pan disposed on a lower end of a skirt part 2a under the cylinder block 2. Inside the cylinder block 2, a liner 13 in which a piston 12 is to be slidably inserted is mounted, and the cylinder head 3 is mounted on the upper end of the liner 13 via a gasket 20.

Further, reference numeral 5 designates an intake pipe connected to the cylinder head 3; 6, an exhaust pipe also connected to the cylinder head 3; 7, an intake passage defined by the cylinder head 3 and the inner surface of the intake pipe 5; 8, an exhaust passage defined by the cylinder head 3 and the inner surface of the exhaust pipe 6; 9, an intake valve mounted in the intake passage 7; and 10, an exhaust valve mounted in the exhaust passage 8.

The engine 1 is furnished with an engine cooling apparatus 11 of the water-cooling type. The cooling apparatus 11 generally comprises a water jacket 14 constructed round the cylinder block 2 as well as the liner 13 and the intake and exhaust valves 9, 10 inside the cylinder head 3, a radiator 15 for cooling a cooling water 19 filled in the water jacket 14, and a water pump 16 for causing the cooling water 19 to be forcibly circulated (indicated by arrows in FIG. 5) within the water jacket 14.

The water jacket 14 is connected, for communication, to the radiator 15 via a cooling-water supply pipe 17 and a cooling-water discharge pipe 18. The water pump 16 is disposed between the cooling-water supply pipe 17 and the water jacket 14.

In the cooling apparatus 11, the cooling water 19 cooled in the radiator 15 is forced by the water pump 16 to flow via the cooling-water supply pipe 17 into the water jacket 14, where the cooling water 19 moves about by convection as indicated by the arrows in FIG. 5 to cool heated parts around the liner 13 and the intake and exhaust valves 9, 10. Then the cooling water 19 is returned into the radiator 15 via the cooling-water exhaust pipe 18 for being cooled again. Cooling of the engine is accomplished by this circulation of the cooling water 19.

However, according to the temperature distribution of the cooling water 19 within the water jacket 14 in the above prior cooling apparatus, it is high temperature at the upper or cylinder-head-side part of the water jacket 14 and near the upper part, and the temperature descends gradually toward the skirt part 2a of the cylinder block 2, which is located near the lower part of the water jacket 14. The temperature distribution of the liner 13 also is non-uniform due to the non-even distribution of the cooling water 19. Because of this non-uniformness of temperature distribution, the liner 13 tends to be deformed irregularly, which would be a cause for the increase of consumed lubricant oil and the increase of slapping sound of the piston as well as local contacting of the piston.

For cooling near the skirt part 2a of the liner 13, the water pump 16 must be excessively operated, thus impairing the cooling efficiency.

To this end, an engine cooling apparatus 21 as shown in FIGS. 6 and 7 has been proposed in an attempt to make the temperature distribution around the liner uniform and also to make the cooling effective.

FIGS. 6 and 7 are very identical with FIGS. 4 and 5; therefore the description of various parts is omitted here for clarity, with similar parts being only designated by like reference numerals.

In the cooling apparatus 21, the water jacket 24 is divided into two parts: a forcible circulation part 24a where the cooling water 19 inside is forcibly moved by the water pump 16, and a natural convection part 24b where the cooling water 19 inside is restrained from forcible movement by the water pump 16.

Specifically, as shown in FIG. 6, the water jacket 24 is divided by a communication hole 22 into two parts: an upper part (forcible circulation part) 24a located over the communication hole 22, and a lower part (natural convection part) 24b located under the communication hole 22. As shown in FIG. 7, the cooling water 19 in the forcible circulation part 24a is forcibly circulated by the water pump 16, while the cooling water 16 in the natural convection part 24b is only allowed to move by natural convection as restrained from forcible circulation by the water pump 16 since the natural convection part 24b is partitioned off the water pump 16.

With this arrangement, the cooling water 19 cooled by the radiator 15 is forced by the water pump 16 to flow via the cooling-water supply pipe 17 into the forcible circulation part 24a, where the cooling water 19 moves about by convection as indicated by arrows in FIG. 7 to cool heated parts around the upper portion of the liner 13 and the intake and exhaust valves 9, 10. Then the cooling water 19 is returned into the radiator 15 via the cooling-water exhaust pipe 18 for being cooled again.

To the contrary, in the natural convection part 24b of the water jacket 24, the cooling water 19 having become high in temperature as absorbed the heat from the liner 13 is moved upwardly adjacent to the communication hole 22 by natural convection. Then this cooling water 19 is returned downwardly, as cooled by the cooling water 19 in the forcible circulation part 24a, to cool the liner 13 again.

Thus the forcing of the cooling water 19 is necessary with respect to only a part (i.e., the forcible circulation part 24a); that is, the total sectional area of the circulating path of the cooling water 19 would be reduced so that the circulation speed of the cooling water 19 can increase yet by using the water pump 16 of the same output, thus not only improving the heat conductivity of the circulation system under forcible circulation, but also increasing the cooling capability at the forcible circulation part 24a.

The natural convection part 24b has a heat conductivity lower than that of the forcible convection part 24a, and hence the cooling water 19 inside also would tend to become high in temperature.

Accordingly, the temperature of the cooling water 19 in the water jacket 24 becomes lower near the cylinder head 3 at the upper part of the water jacket 24, compared to the previous arrangement, and becomes higher near the skirt part 2a of the cylinder block 2 at the lower part of the water jacket 24, thus resulting in an almost uniform distribution of temperature of the cooling water 19. Therefore the liner 13 also would be uniform in either temperature distribution or deformation, and so it is expected that the increase of consumed lubricant oil and the increase of slapping sound of the piston as well as local contacting of the piston.

However, merely dividing the water jacket 24 into the two parts, i.e., the forcible circulation part 24a and the natural convection part 24b would reduce the heat conductivity at the natural convection part 24b sharply only to increase the possibility that the liner 13 cannot be cooled all the way down to a desired temperature.

SUMMARY OF THE INVENTION

It is therefore an object of this invention to provide a partial-boil cooling apparatus, for an engine, in which apparatus a liner of a cylinder block can be cooled with improved efficiency and reliability down to a desired temperature so as to give a uniform distribution of temperature.

According to this invention, there is provided a partial-boil cooling apparatus for an engine, comprising: a water jacket including (i) a forcible circulation part located chiefly round a cylinder head of the engine for forcibly circulating a cooling water in said water jacket by a water pump, and (ii) a natural convection part located chiefly round a liner of a cylinder block of the engine for allowing a combined coolant to move by a natural convection with restraining the cooling water from forcible circulation by the water pump; and the natural convection part being filled at its upper space with the cooling water and at its lower space with the cooling medium having a boiling point around a temperature zone to cool the liner and also having a specific gravity larger than that of the cooling water and immiscible with the cooling water.

With the partial-boil cooling apparatus thus constructed, in the forcible circulation of the water jacket, the cooling water inside is forcibly moved to circulate to cool chiefly the cylinder head. On the other hand, in the natural convection part, the cooling water and a cooling medium different therefrom are refrained from forcible circulation by the water pump so that these two kinds of coolants are allowed to move by natural convection to cool chiefly the liner of the cylinder block. During that time, if inside the natural convection part, the liner is heated up to a high temperature zone to be cooled, the cooling medium is boiled with absorbing the heat of the liner very much. The liner is thereby prevented from temperature increase over the temperature zone and is hence kept within a desired temperature zone. Meanwhile, the cooling medium boiled in the natural convection part is moved upwardly within the natural convection part by buoyancy, and is then liquefied again upon contact with the cooling water at the upper part. The cooling medium in liquid state descends in the natural convection part by its own weight to cool the liner again.

By the boiling and cooling action of high cooling efficiency which action is achieved with the natural convection of the cooling medium in the natural convection part, the liner can be cooled with efficiency.

The above and other advantages, features and additional objects of the present invention will be manifest to those versed in the art upon making reference to the following detailed description and the accompanying drawings in which a structural embodiment incorporating the principles of the present invention is shown by way of illustrative example.

DETAILED DESCRIPTION

The principles of this invention are particularly useful when embodied in a partial-boil cooling apparatus for an engine. One embodiment of this invention will now be described with reference to the accompanying drawings.

Figure 1:
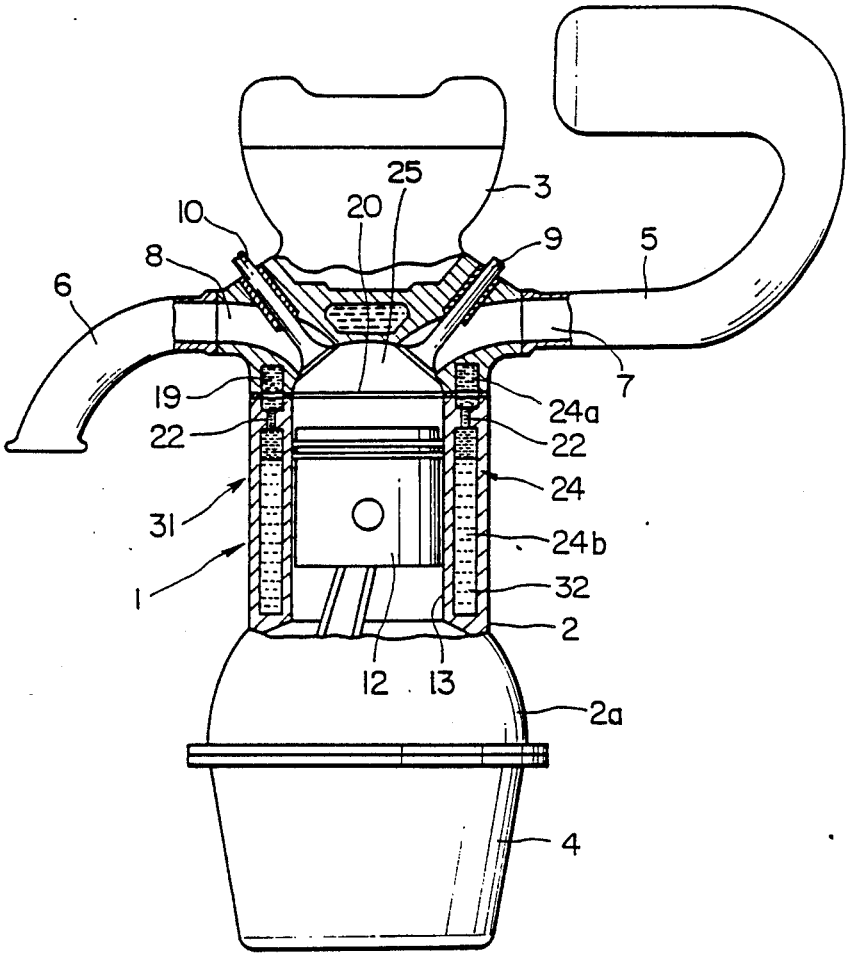
FIG. 1 is a vertical cross-sectional view of an engine in which a partial-boil cooling apparatus embodying this invention is incorporated.
Figure 2:
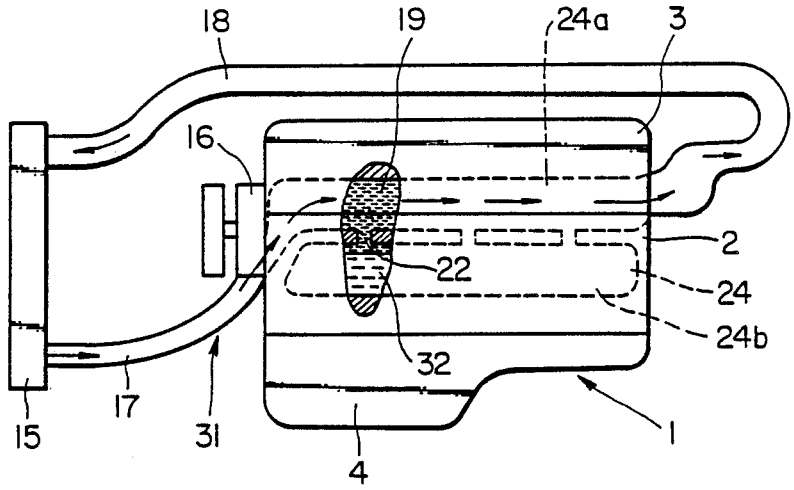
FIG. 2 is a side elevational view, partially broken away, of the engine of FIG. 1.

In FIGS. 1 and 2, reference numeral 1 designates an engine; 2, a cylinder block partially constituting a body of the engine 1; 3, a cylinder head partially constituting the body of the engine 1; and 4, an oil pan disposed on a lower end of a skirt part 2a under the cylinder block 2. Inside the cylinder block 2, a liner 13 in which a piston 12 is to be slidably inserted is mounted, and the cylinder head 3 is mounted on the upper end of the liner 13 via a gasket 20.

Further, reference numeral 5 designates an intake pipe connected to the cylinder head 3; 6, an exhaust pipe also connected to the cylinder head 3; 7, an intake passage defined by the cylinder head 3 and the inner surface of the intake pipe 5; 8, an exhaust passage defined by the cylinder head 3 and the inner surface of the exhaust pipe 6; 9, an intake valve mounted in the intake passage 7; and 10, an exhaust valve mounted in the exhaust passage 8.

The engine 1 is furnished with a partial-boil cooling apparatus (hereinafter called "cooling apparatus") 31. The cooling apparatus 31 generally comprises a water jacket 24 constructed round the cylinder block 2 as well as the liner 13, a combustion chamber 25 and the intake and exhaust valves 9, 10 inside the cylinder head 3, a radiator 15 for cooling a cooling water 19 filled in the water jacket 24, and a water pump 16 for causing the cooling water 19 to be forcibly circulated (indicated by arrows in FIG. 2) within the water jacket 24.

The water jacket 24 is connected, for communication, to the radiator 15 via a cooling-water supply pipe 17 and a cooling-water discharge pipe 18. The water pump 16 is disposed between the cooling-water supply pipe 17 and the water jacket 24.

Specifically, as shown in FIG. 1, the water jacket 24 is divided by a communication hole 22 into two parts: an upper part (forcible circulation part) 24a located over the communication hole 22, and a lower part (natural convection part) 24b located under the communication hole 22. As shown in FIG. 2, the cooling water 19 in the forcible circulation part 24a is forcibly circulated by the water pump 16, while the cooling medium 32 in the natural convection part 24b is only allowed to move by natural convection as restrained from forcible circulation by the water pump 16 since the natural convection part 24b is partitioned off the water pump 16.

The natural convection part 24b is filled with a combined coolant composed of: a cooling medium 32 of a material different from the cooling water 19 and occupying the natural convection part 24b up to a predetermined level; and a portion of the cooling water 19 penetrated from the forcible circulation part 24a into the upper portion of the cooling medium 32. This cooling medium 32 is a liquid having (i) a boiling point around a temperature zone to cool the liner 13, (ii) a specific gravity larger than that of the cooling water 19, and (iii) immiscible with the cooling water 19.

Here the "temperature zone" to cool the liner 13 means a temperature range within which the temperature of the liner 13 is to be kept at the start of the engine 1. For example, assuming that the temperature of the liner 13 is to be set so as to be kept at or below a least upper bound of 110° C., the cooling medium 32 should have a boiling point (e.g., about 100° C. ) slightly lower than the least upper bound (110° C.) of the temperature zone at an internal pressure (e.g., about 1300 to 1400 mmHg).

The liquid having this boiling point, a specific gravity larger than that of the cooling water 19, and immiscible with the cooling water 19 is exemplified by flon.

There are known a variety of flons, which generally are indissoluble in water and antipathic thereto; Some flons are larger in specific gravity than water. And some of these flons have a boiling point of about 100° C. at an internal pressure of the water jacket 24 during normal operation and hence may be adopted for the cooling medium 32. For selection of a flon, it is necessary to choose one that is very small in ozone rupturing power. Flon 225, for example, satisfies these conditions and hence may be used for the cooling medium 19.

The amount of the cooling medium (flon) 32 to be loaded is adjusted in such a manner that its liquid phase surface with the cooling water 19 is located below the communication hole 22 by a predetermined extent in the natural convection part 24b of the water jacket 24. The level of this liquid phase surface is preferably set so as to leave room at the uppermost portion of the natural convection part 24b, which is for the purpose of keeping the cooling medium 32 normally within the natural convection part 24b.

The cooling capability of the forcible circulation part 24a of the water jacket 24 is set in such a manner that the cooling water 19 at the upper portion of the natural convection part 24b is kept at a temperature lower than the boiling point of the cooling medium 32. For example, if the boiling point of the cooling medium 32 is about 100° C., the setting is such that the cooling water 19 in the upper portion of the natural convection part 24a is cooled down to about 90° C.

In the partial-boil cooling apparatus 31 constructed as described above, the cooling water 19 cooled in the radiator 15 is moved into the forcible circulation part 24a of the water jacket 24 as driven by the water pump 16, and is forcibly circulated by the driving force of the water pump 16, as indicated by the arrows in FIG. 2, to cool the heated parts around the peripheral upper part of the liner 13 as well as the combustion chamber 25 and the valves 9, 10 above the peripheral upper part of the liner 13. Subsequently, the cooling water 19 is returned into the radiator 15 for being recooled.

With repeated convection circulation, the engine is cooled by the cooling water 19, during which time the liner 13 at its main part except the upper part is cooled in the following manner.

Figure 3:
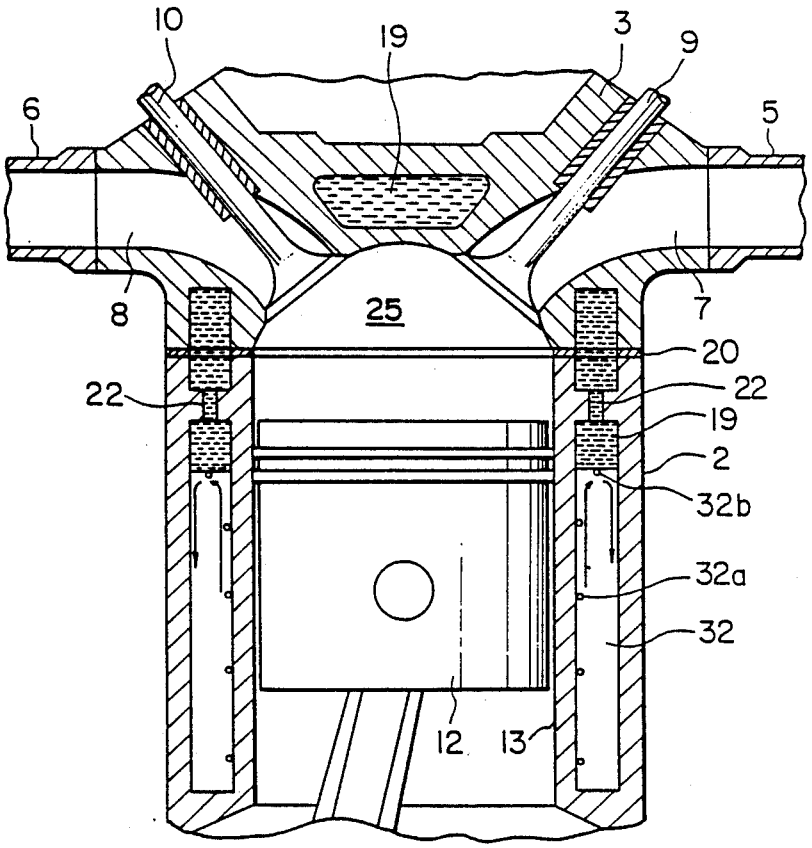
FIG. 3 is a fragmentary enlarged cross-sectional view of the cooling apparatus, illustrating its mode of operation.
Figure 4:
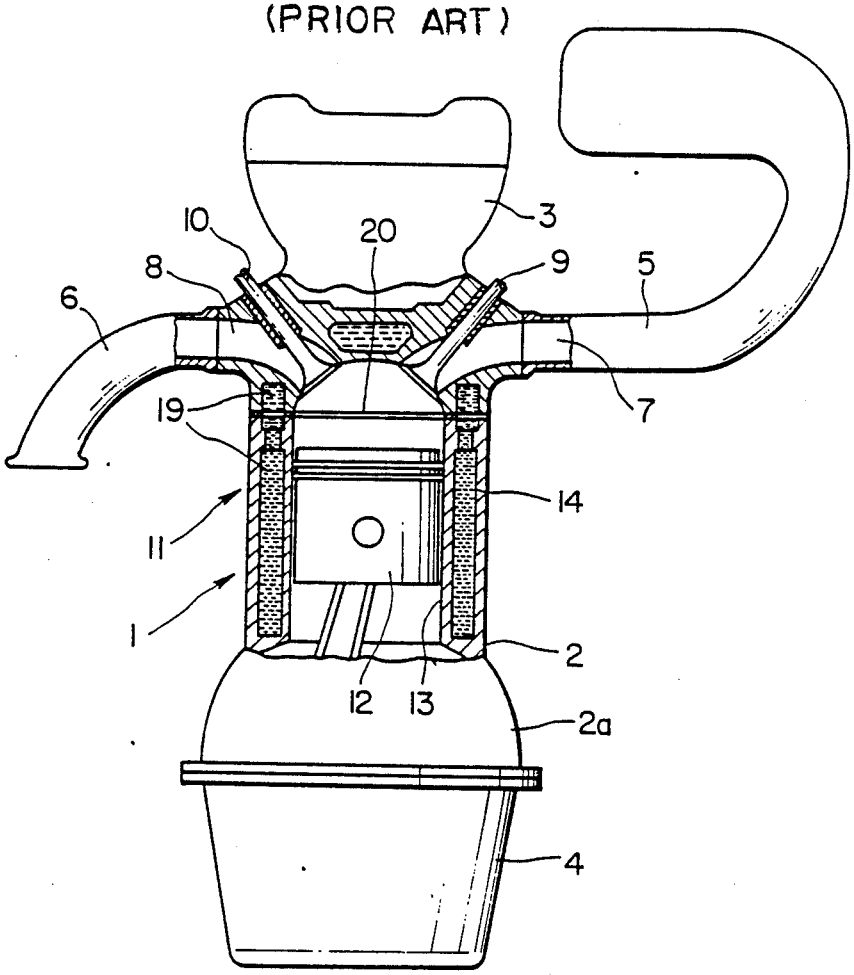
FIG. 4 (PRIOR ART)
FIG. 4 is a vertical cross-sectional view of an engine in which a conventional cooling apparatus is incorporated.
Figure 5:
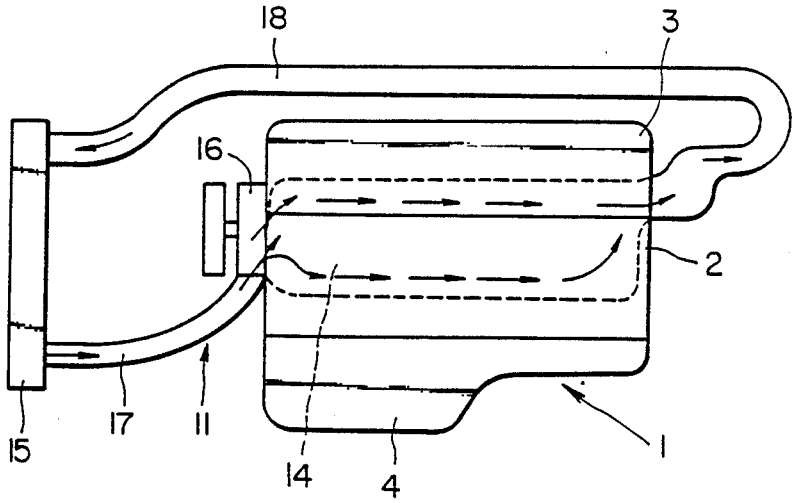
FIG. 5 (PRIOR ART)
FIG. 5 is a side elevational view of the engine of FIG. 4.
Figure 6:
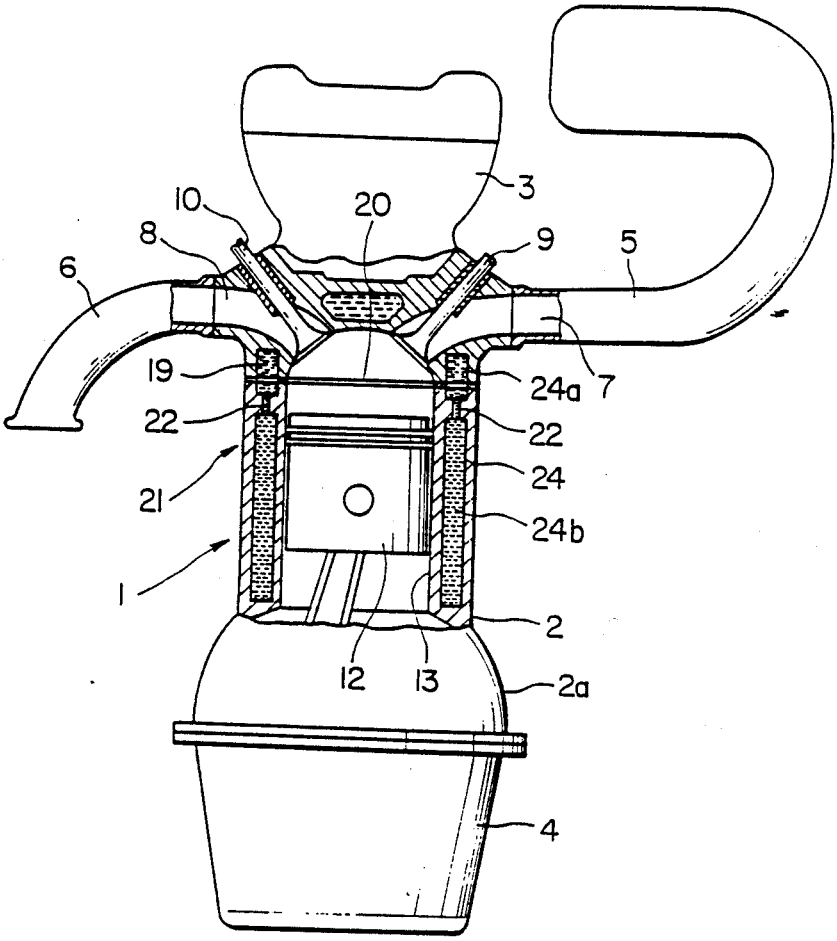
FIG. 6 PRIOR ART
FIG. 6 is a view similar to FIG. 4, showing another conventional cooling apparatus.
Figure 7:
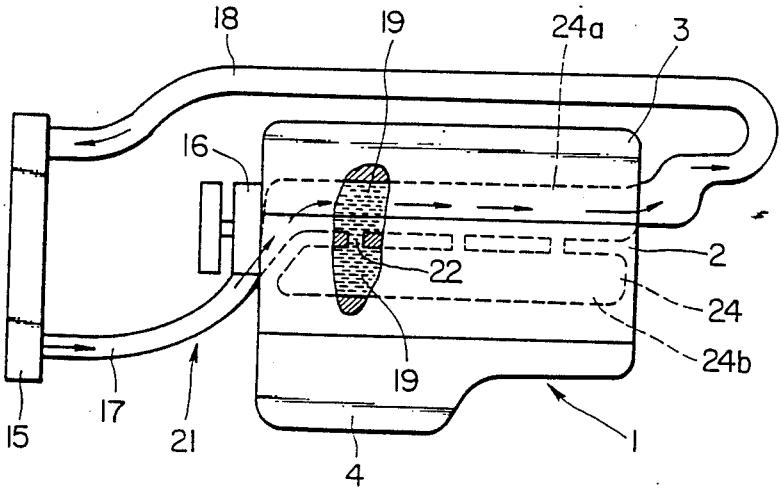
FIG. 7 PRIOR ART
FIG. 7 is a side elevational view of FIG. 6.

Specifically, as shown in FIG. 3, the cooling medium 32 filled in the natural convection part 24b of the water jacket 24 absorbs the heat of the liner 13 remarkably to become boiled at the preset temperature zone to cool the liner 13. Here when the liner 13 is heated up to a temperature slightly below 110° C., the liner-side inside wall surface of the natural convection part 24b becomes heated at about 105° C., for example so that the cooling medium 32 having a boiling point of about 100° C. becomes boiled by itself, as comes in contact with the liner-side inside wall surface, to absorb a large amount of heat from the liner 13.

This boiled cooling medium 32a in a gas state is moved upwardly in the natural convection part 24b by buoyancy; as it comes in contact with the cooling water 19 penetrated into the natural convection part 24b through the communication hole 22 (at 32b), heat of the cooling medium 32 is absorbed by the cooling water 19 without being mixed with the cooling water. As a result, the cooling medium 32 is cooled to become liquefied again. This is because the cooling water 19 penetrated into the natural convection part 24b is kept at a temperature (about 90° C.) below the boiling point (about 100° C.) of the cooling medium 32.

Then the liquefied cooling medium 32 is moved downwardly in the natural convection part 24b by its own weight to cool the liner 13 again.

Repeating this convection circulation, the cooling medium 32 in the natural convection part 24b becomes boiled by itself to cool the liner 13 contacting the cooling medium 32. By this boiling and cooling action, the cooling medium 32 cools the liner 13 with high efficiency normally to a preset temperature zone [range from 110° C. to about 100° C. (boiling point of the cooling medium)].

Since the heat conductivity due to the boiling and cooling action is higher about one hundred times, compared to that in the case of the normal natural convection, a remarkably improved degree of cooling capability can be expected. Therefore it is possible to cool the liner 13 to a desired temperature reliably.

Consequently, driving the cooling water is required only with respect to the part (i.e., forcible circulation part) 24a of the water jacket 24, and the total sectional area of the circulating path of the cooling water 19 is reduced so that the circulating speed of the cooling water can be increased even by the water pump 16 of the same output. Since the heat conductivity of the circulation system under forcible circulation is improved to increase the cooling capability of the forcible circulation part 24a, it is possible to keep the cooling water 19 in the forcible circulation part 24a reliably at a suitable temperature (e.g., 90° C.) lower than its boiling point.

Further, because the amount of cooling water to be forcibly circulated can be reduced, it is possible to accelerate the warming-up at the start of the engine.

Regarding the temperature distribution of the cooling water 19 in the water jacket 24, it is lowered around the cylinder head 3, i.e., the upper part of the cylinder head 3, compared to the conventional art, and it can be adjusted around the skirt part 2*a* of the cylinder block 2, i.e., the lower part of the water jacket 24 to such a range that the temperatures of the cooling water 19 and the cooling medium 32 are kept below their respective constant levels so as not to cause an excessive cooling, thus uniforming the temperature distributions of the cooling water 19 and the cooling medium 32. As the temperature distribution of the liner 13 is thereby be made uniform, the liner 13 is deformed also in a uniform fashion to prevent the increase of consumed lubricant oil as well as the increase of slapping sound of the piston and local contacting of the piston.

In this illustrated embodiment, the communication hole 22 is disposed in the upper peripheral part of the liner 13, and the forcible circulation part 24*a* is located over this communication hole 22, namely, at the upper part of the cylinder block 2 and the cylinder head 3, while the natural convection part 24*b* is located below the communication hole 22, namely, under the upper part of the cylinder block 2. The position of the communication hole 22 may be otherwise set depending on the exothermic distribution, for example, of the engine to be cooled. For instance, the communication hole 22 may extend through the joint between the cylinder head 3 and the cylinder block 2. In any case, it is sufficient that the forcible circulation part 24*a* is located chiefly at the cylinder head 3, while the natural convection part 24*b* is located chiefly at the cylinder block 2.

Further, the temperature to cool the liner 13 and the preset temperature of the cooling water 19 in the upper part of the natural convection part 24*b* should by no means be limited to the above-mentioned specific values and may be set otherwise as desired In selecting the kind of the cooling medium 32, one having a boiling point corresponding to the preset temperature may be selected For instance, assuming that the least upper bound of the liner 13 is about 130° C., it is recommended that the cooling medium 32 should have a boiling point (e.g., about 120° C.) slightly lower than this least upper bound temperature of 130° C. at an internal pressure of the water jacket 24 during normal operation.

Yet, the engine equipped with the abovementioned cooling apparatus 31 should not limited to the illustrated example and may be of an alternative type different in number of cylinders and/or in shape.

According to the partial-boil cooling apparatus of this invention, the cooling efficiency and capability of an engine can be remarkably improved, and the warming-up at the start of an engine can be accelerated. Further, since the liner and associated parts therearound can be cooled uniformly, the deforming of the liner during an engine is in operation would be uniform, thus preventing the increase of consumed lubricant oil as well as the increase of slapping sound of the piston and local contacting of the piston.

What is claimed is:

1. A partial-boil cooling apparatus for an engine, comprising:

a water jacket including (i) a forcible circulation part located chiefly round a cylinder head of the engine for forcibly circulating a cooling water in said water jacket by a water pump, and (ii) a natural convection part located chiefly round a liner of a cylinder block of the engine for allowing a combined coolant composed of said cooling water and a cooling medium different therefrom in said natural convection part to move by natural convection with restraining said coolant from forcible circulation by said water pump; and said natural convection part being filled at its upper space with said cooling water and at its lower space with said cooling medium having a boiling point around a temperature zone to cool said liner, said cooling medium having a specific gravity larger than that of said cooling water and immiscible with antipathic to said cooling water.

2. A partial-boil cooling apparatus according to claim 1, wherein said forcible circulation part is defined by a space inside the cylinder head and another space above said liner in said cylinder block.

3. A partial-boil cooling apparatus according to claim 2, wherein said natural convection part surrounds said liner in said cylinder block and communicates with said space of said forcible circulation part above said liner via a communicating hole.

4. A partial-boil cooling apparatus according to claim 1 wherein said cooling medium is flon.

* * * * *